United States Patent [19]

Daenen

[11] 4,222,827

[45] Sep. 16, 1980

[54] ELECTROPLATING SOLUTION FOR THE ELECTRODEPOSITION OF ALUMINIUM

[75] Inventor: Theo E. G. Daenen, Eindhoven, Netherlands

[73] Assignee: U.S. Philips Corporation, New York, N.Y.

[21] Appl. No.: 39,718

[22] Filed: May 17, 1979

[30] Foreign Application Priority Data

May 22, 1978 [NL] Netherlands ..... 7805490

[51] Int. Cl.[2] ..... C25D 3/44

[52] U.S. Cl. ..... 204/14 N

[58] Field of Search ..... 204/14 R, 14 N, 39

[56] References Cited

U.S. PATENT DOCUMENTS

| | | | |
|---|---|---|---|
| 2,170,375 | 8/1939 | Mathers | 204/14 N |
| 2,651,608 | 9/1953 | Brenner | 204/14 N |
| 3,268,421 | 8/1966 | McGraw | 204/39 |
| 3,595,760 | 7/1971 | Ishibashi | 204/14 N |
| 3,929,611 | 12/1975 | Hess | 204/14 N |
| 4,145,261 | 3/1979 | Daenen et al. | 204/14 N |

*Primary Examiner*—T. M. Tufariello

*Attorney, Agent, or Firm*—Norman N. Spain

[57] ABSTRACT

Electrolyte liquid for electrodepositing ductile aluminium. The liquid comprises, dissolved in an aprotic liquid, an alkali aluminium hydride and aluminum hydride coordinatively bound to a tertiary amine, a tertiary diamine or an arylphosphine.

4 Claims, No Drawings

ELECTROPLATING SOLUTION FOR THE ELECTRODEPOSITION OF ALUMINIUM

The invention relates to an electroplating solution for electrodepositing ductile aluminum on at least superficially electrically conducting substrates and to aluminum layers, obtained by means thereof on substrates.

U.S. Pat. No. 3,929,611 discloses such an electroplating solution which solution comprises anhydrous aluminum chloride and a mixed metal hydride, such as lithium aluminum hydride in an anhydrous aprotic solvent. An ether compound, chosen from the group diethylether, ethyl-n-butylether, anisoles, phenetole and diphenylether is used as the solvent. White, ductile aluminum is electrodeposited from these electroplating solutions.

These liquids have the drawback that aluminum chloride reacts with water vapour, hydrogen chloride then being produced. This compound adversely affects the quality of the deposited aluminum.

The electroplating solution for the electrodeposition of aluminium, comprising a solution of $MIAlH_4$ and/or $MII(AlH_4)_2$, respectively, in an anhydrous aprotic solvent, MI being an alkali metal or quaternary ammonium and MII an alkaline earth metal is characterized according to the invention in that the solution also contains aluminum hydride, coordinatively bound to a tertiary amine, an aryl phosphine or a tertiary diamine in a molar ratio relative to the compound $MIAlH_4$ and MII $(AlH_4)_2$ respectively, of between 4 and 0,25 and in a quantity to the saturation concentration.

The molar ratio of the compounds $MAlH_4$: $AlH_3$,L, wherein L is a tertiary amine, a tertiary diamine or an arylphosphine is between 4 and 0,25, but depends on the current density used to deposit aluminum: for lower current densities ($\sim$0,5 A/dm$^2$) this ratio is higher ($\sim$4) than for higher current densities ($\sim$2 A/dm$^2$): $\sim$1.

The invention is based on the recognition that the alkylamine acts as a stabiliser with respect to the aluminum hydride.

It is possible to deposit aluminum of a very good quality and sometimes with remarkable properties by means of the bath according to the invention. An advantage of the liquids according to the invention is that the coordinative aluminum hydride compounds dissolve in a large number of aprotic organic liquids.

In addition to diethylether it is also possible to use other ethers, such as ethyl-n-butylether, diphenylether, dibutylether and solvents such as toluene, tetrahydrofurane and diethylene glycol dimethylether etc. as the solvent. Advantageous are materials defined by the general formula $$R—[-O-(CH_2)_m]_p\ O—[-(CH_2)_n—O]_q R'$$

having a flash point over 40° C., in which formula m and n represent integers between 1 and 6, p and q having values of 0, 1, 2 or 3, and R and R' represent alkyl groups.

Mixtures of the solvents with amines and/or with toluene are also usable.

Excellently adhering aluminum can be deposited from electroplating liquids in which diethylether is used as the solvent.

The preparation of a large number of coordination compounds of $AlH_3$ (with ligands) has been discussed in the literature: inter alia in the handbook "Hydrides" by E. Wiberg and E. Amberger, Elsevier, Amsterdam, Chapter 5, pages 381–438 and Russian Chemical Reviews (Uspyechi Chimii), 35, September 1966, pages 649–658.

Thus, the $AlH_3$ may be prepared separately and thereafter added in the pure form to the electrolyte liquid. A simple and effective preparation starts from $LiAlH_4$ and $AlCl_3$ in the presence of trimethylamine in a diethylether solution, from which the compound $AlH_3.2\ (CH_3)_3N$ crystallizes or a similar preparation in the presence of tri-ethylamine, furnishing the compound $AlH_3.(C_2H_5)_3N$ in the crystalline form. These compounds are rather stable and are therefore very suitable for storage. Alternatively, it is possible to prepare a starting material by having a suitable excess of $AlH_3$.L, for example 1.25 M $AlH_3$.L, react with MIH, and $MIIH_2$, respectively, for example with 0,25 M LiH.

The invented electrolyte liquids may also be prepared by the in situ formation of the aluminum hydride from $LiAlH_4$ and $AlCl_3$ in accordance with the equation $$3LiAlH_4 + AlCl_3 \rightarrow 4AlH_3 + 3LiCl.$$

LiCl is then formed which also increases the conductivity of the electrolyte liquid.

In accordance with a preferred embodiment of the liquid it is advantageous to increase the conductivity thereof by adding a non-reacting conducting electrolyte, for example an alkaline halide.

The following embodiments are given by way of explanation:

Preparation of $AlH_3.2N(CH_3)_3$

A mixture of 550 ml diethylether and 250 ml triethyl amine, dried on molecular sieves, is added to 50 g pure $LiAlH_4$ in a 2 l flask in an atmosphere argon. The $LiAlH_4$ dissolves therein exothermically. 56.8 g $AlCl_3$ is stirred into the solution at 0° C. Thereafter the suspension is stirred for 12 hours at ambient temperature, thereafter 250 ml triethyl amine is added and the suspension is passed through a D4 filter in argon.

Analyses of the filtrate:

1.18 mole/l Al $1.21 \times 10^{-3}$ mole/l Li $31 \times 10^{-3}$ mole/l Cl 200 ml of the filtrate thus obtained is cooled to −70° C. (acetone-solid $CO_2$). Trimethyl amine vapour is passed through this solution for 2 hours, white acicular crystals being formed in the solution during this bubbling process. These crystals are filtered off, washed with anhydrous pentane and dried by means of a vacuum pump. The crystalline compound $AlH_3.2N(CH_3)_3$ is stable at room temperature and is suitable for storage if stored in an inert anhydrous atmosphere.

Preparation of $AlH_3.N(C_2H_5)_3$

The above-mentioned filtrate is reduced to half the original quantity by means of evaporation and thereafter kept in an argon atmosphere in a 2 l flask at −25° C. Crystals of $AlH_3.N(C_2H_5)_3$ are not formed until after a long period of time (2–3 weeks). The crystallisation is markedly accelerated by the addition of a seed crystal. The crystalline compound $AlH_3.N(C_2H_5)_3$ melts at 19° C.; the liquid $AlH_3.N(C_2H_5)_3$ is stable at room temperature and is suitable for storage if stored in an inert, anhydrous atmosphere.

Preparation of other $AlH_3.L$ compounds

An excess of tertiary amine (L) is added to the filtrate and the solution is stored at −25° C. The compounds which crystallize from these solutions are suitable for storage if stored in an inert, anhydrous atmosphere. Preparation was effected for L = $N(C_4H_9)_3$ and L = 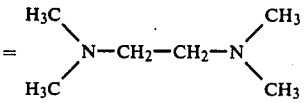

EXAMPLE 1

34 g $AlH_3.N(C_2H_5)_3$ are added to 200 ml of a 0.5 mole/l solution of $LiAlH_4$ in diethyleneglycoldimethylether. The conductivity of this clear, colourless solution is $H=8mScm^{-1}$ (1 Siemens=1 $Ohm^{-1}$). An electroplating test is performed with a copper cathode and an aluminum plate as the anode. The solution was stirred during the electrolysis process. When current is passed through the bath, white properly adhering and ductile aluminum is deposited onto the cathode. The plating voltage is 3.8 V at a current of 100 mA (current density 2 $A/dm^2$).

EXAMPLE 2

250 ml of tetrahydrofurane is added in an argon atmosphere to 20 g $NaAlH_4$ in a 2 l flask. The suspension is stirred for 1 hour and passed through a D4 filter. The conductivity of the filtrate is $H=7.2mScm^{-1}$. 11.3 g $AlH_3.N(C_2H_5)_3$ is added to this filtrate and the solution thus obtained is used for an electroplating test. The electroplating is performed with an Al-anode and a copper rod ad the cathode. The solution is stirred during the electrolysis process. When current is passed through the bath white, ductile Al is deposited onto the copper rod. The plating voltage is 3.6 V at a current of 300 mA (current density 3 $A/dm^2$).

EXAMPLE 3

6.5 g $LiAlH_4$ is dissolved in an argon atmosphere in 130 ml diethyleneglycoldimethylether in a 1 l flask. The suspension is stirred for 1 hour and thereafter passed through a D4 filter. The electrolysis solution is obtained by adding 24 g $AlH_3.2N(CH_3)_3$ to this filtrate. The conductivity of the liquid is $H=3\ mScm^{-1}$. The electrolysis is performed with an Al-anode and a copper rod as the cathode. When current is passed through the bath white and ductile Al is deposited onto the cathode. The plating voltage is 2.4 V at a current of 100 mA (current density 1 $A/dm^2$.

EXAMPLE 4

In a 2 l round-bottomed flask 200 ml diethylether, which was dried by means of molecular sieves is added to 25 g $LiAlH_4$ under argon. The $LaAlH_4$ dissolves exothermically in the ether. Then 75 ml triethylamine, which has also been dried by means of molecular sieves is added to the mixture and the mixture thus obtained is heated under reflux for 3 hours. After cooling to 0° C., 12.2 g pure anhydrous $AlCl_3$ is stirred into the mixture, whereafter the mixture then obtained is stirred for 30 minutes at room temperature.

After filtration in an argon atmosphere a solution is obtained which contains an excess of $LiAlH_4$ and is saturated with $AlH_3$ and LiCl. When current is passed through the bath properly adhering, crystalline aluminum is deposited onto a copper rod from this electrolyte solution. The conductivity H at room temperature is 0.95 $mScm^{-1}$. The plating voltage is 8.2 V with a current of 100 mA. (current density 1 $A/dm^2$).

EXAMPLE 5

In a 2 l flask a mixture of 300 ml tetrahydrofurane and 100 ml triethylamine, dried by means of molecular sieves ia ddded under argon to 25 g pure $LiAlH_4$. The $LiAlH_4$ dissolves exothermically therein. 18.3 g $AlCl_3$ is stirred into the mixture at 0° C. The suspension is stirred at room temperature for 30 minutes, thereafter a mixture of 75 ml tetrahydrofurane and 25 ml triethylamine is added and the suspension is passed through a D4 filter. The filtrate obtained is used as electrolyte solution. It furnishes properly adhering, ductile aluminum on a cathode consisting of copper. The conductivity H at room temperature is 9.5 $mScm^{-1}$. A bath voltage of 1.05 V is measured at a current strength of 100 mA. The composition per liter of the bath is:

1.06 mole LiCl
0.43 mole $LiAlH_4$ and
0.50 mole $AlH_3.N(C_2H_5)_3$

What is claimed is:

1. An electroplating solution for electro-depositing ductile aluminum on at least superficially electrically conducting substrates, said solution comprising $MIAlH_4$ or $MII(AlH_4)_2$, in a quantity up to the saturation concentration in an anhydrous aprotic solvent, where MI is an alkali metal or quaternary ammonium and M II is an alkaline earth metal, and aluminum-hydride, coordinatively bound to a tertiary amine, an aryl-phosphine or a tertiary diamine in a molar ratio relative to the compound $MIAlH_4$ or $MII(AlH_4)_2$ of between 4 and 0.25 and in a quantity up to the saturation concentration.

2. An electroplating solution as claimed in claim 1, wherein a material defined by the general formula $$R\text{-}[O-(CH_2)_m]_p O\text{-}[(CH_2)_n-O]_q R'$$

having a flash point over 40° C. is used as the solvent, in which formula m and n are integers between 1 and 6, p and q have values of 0, 1, 2 or 3 and R and R' represent alkyl groups.

3. An electroplating solution liquid as claimed in claim 1, wherein diethylether is used as the solvent.

4. An electroplating solution as claimed in claims 1, 2 or 3, wherein the liquid also contains a conductivity-increasing electrolyte.

* * * * *

UNITED STATES PATENT OFFICE

CERTIFICATE OF CORRECTION

Patent No. 4,222,827 Dated September 16,1980

Inventor(s) Theo E.G. Daenen

It is certified that error appears in the above-identified patent and that said Letters Patent are hereby corrected as shown below:

Change Title to read as follows:

-- ELECTROPLATING SOLUTION FOR THE ELECTRODEPOSITION OF ALUMINUM --

Col. 4, line 51, After "over" change "40° C." to

-- 40° C --

Signed and Sealed this

Third Day of March 1981

[SEAL]

Attest:

RENE D. TEGTMEYER

Attesting Officer

Acting Commissioner of Patents and Trademarks